US008359953B2

(12) United States Patent
Lin

(10) Patent No.: US 8,359,953 B2
(45) Date of Patent: Jan. 29, 2013

(54) TOOL ELEMENT

(76) Inventor: Chia-Yun Lin, Taichung (TW)

( * ) Notice: Subject to any disclaimer, the term of this patent is extended or adjusted under 35 U.S.C. 154(b) by 332 days.

(21) Appl. No.: 12/799,497

(22) Filed: Apr. 26, 2010

(65) Prior Publication Data

US 2011/0259160 A1 Oct. 27, 2011

(51) Int. Cl.

| | |
|---|---|
| ***B25B 13/48*** | (2006.01) |
| ***B25B 13/06*** | (2006.01) |
| ***B25B 13/58*** | (2006.01) |
| ***B25B 13/16*** | (2006.01) |
| ***B25B 13/00*** | (2006.01) |
| ***B25B 23/16*** | (2006.01) |
| ***B25B 13/02*** | (2006.01) |
| ***B67B 7/14*** | (2006.01) |
| ***B67B 7/04*** | (2006.01) |
| ***B25G 1/00*** | (2006.01) |
| ***B25G 3/02*** | (2006.01) |
| ***B25G 3/18*** | (2006.01) |

(52) U.S. Cl. ..... 81/184; 81/436; 81/121.1; 81/173; 81/124.6; 81/3.4; 81/3.48; 81/124.2; 81/177.85; 81/125; 81/28; 81/29

(58) Field of Classification Search ..... 81/184, 81/173, 3.4, 3.48, 121.1, 124.2, 125, 177.85, 81/28, 29

See application file for complete search history.

(56) References Cited

U.S. PATENT DOCUMENTS 7,627,968 B2 * 12/2009 Lin ..... 40/306
2006/0278050 A1 * 12/2006 Hsiao ..... 81/451

* cited by examiner

*Primary Examiner* — Monica Carter
*Assistant Examiner* — Danny Hong
(74) *Attorney, Agent, or Firm* — Charles E. Baxley

(57) ABSTRACT

A tool element has a body and an anti-skid collar. The body has an external surface, a connecting end, an operating end, a mounting recess and multiple notches. The mounting recess is annularly formed round the external surface of the body between the ends and has a bottom face. The notches are formed on the bottom face of the mounting recess at intervals. The anti-skid collar is an annular collar, is detachably mounted around the body and has an inner surface, an outer surface, a holding face and an anti-skid face. The holding face is formed on the inner surface and is rubbed against the notches of the body to hold the anti-skid collar securely on the body. The anti-skid face is formed on the outer surface of the anti-skid collar.

5 Claims, 3 Drawing Sheets

TOOL ELEMENT

BACKGROUND OF THE INVENTION

1. Field of the Invention

The present invention relates to a tool element, and more particularly to a tool element that can be used conveniently and can provide a skid-proof effect.

2. Description of Related Art

A socket wrench or a screwdriver is used to loosen or fasten a nut or a bolt. After the nut or the bolt is loosened from a corresponding bolt or nut, a socket of the socket wrench or a bit of the screwdriver is rotated to separate from the nut or the bolt.

However, the socket or the bit usually has an annular and smooth external surface, and a user always wears with gloves or is stained with lubricating fluid or oil on hands. This may cause rotating the socket or bit difficult. In addition, the conventional socket or the bit may roll arbitrarily due to the annular and smooth external surface and this is inconveniently in used and store.

The invention provides a tool element that mitigates or obviates the aforementioned problems.

SUMMARY OF THE INVENTION

The main objective of the present invention is to provide a tool element that can be used conveniently and can provide a skid-proof effect.

The tool element in accordance with the present invention has a body and an anti-skid collar. The body has an external surface, a connecting end, an operating end, a mounting recess and multiple notches. The mounting recess is annularly formed round the external surface of the body between the ends and has a bottom face. The notches are formed on the bottom face of the mounting recess at intervals. The anti-skid collar is an annular collar, is detachably mounted around the body and has an inner surface, an outer surface, a holding face and an anti-skid face. The holding face is formed on the inner surface and is rubbed against the notches of the body to hold the anti-skid collar securely on the body. The anti-skid face is formed on the outer surface of the anti-skid collar.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
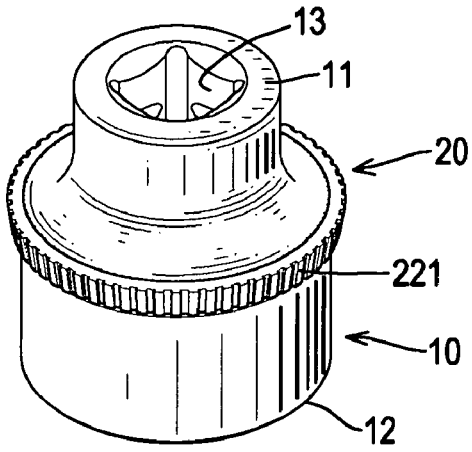
FIG. 1 is a perspective view of a first embodiment of a tool element in accordance with the present invention.

With reference to FIGS. 1 to 5, a tool element in accordance with the present invention comprises a body (10, 10A, 10B) and an anti-skid collar (20, 20A, 20B).

The body (10, 10A, 10B) may be a socket or a bit and has an external surface, a connecting end (11, 11A, 11B), an operating end (12, 12A, 12B), a mounting recess (15, 15A, 15B) and multiple notches (16, 16A, 16B).

Figure 4:
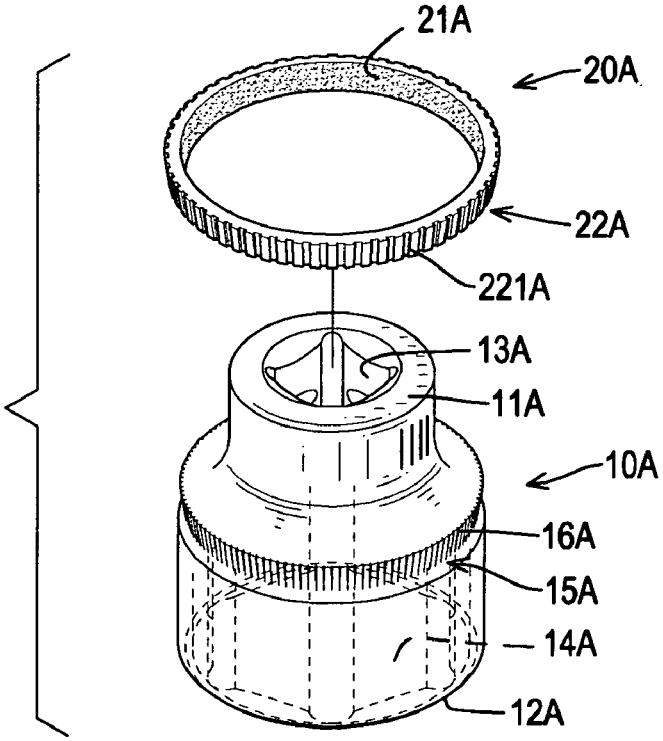
FIG. 4 is an exploded perspective view of a second embodiment of a tool element in accordance with the present invention.

The connecting end (11, 11A, 11B) of the body (10, 10A, 10B) can be connected to a wrench or a screwdriver. With reference to FIGS. 1 and 4, the connecting end (11, 11A) of the body (10, 10A) may have a quadrate mounting hole (13, 13A). With reference to FIG. 5, the connecting end (11B) of the body (10B) may be a hexagonal shaft (13B).

Figure 3A:
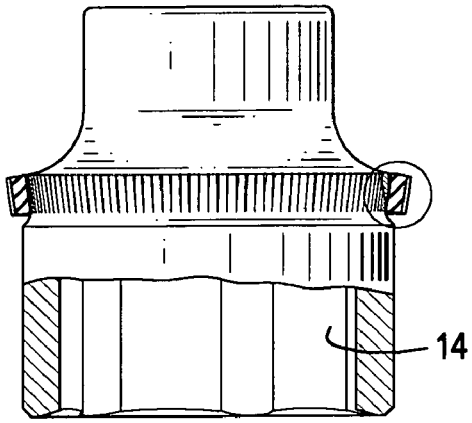
FIG. 3A is a side view in partial section of the tool element in FIG. 1.
Figure 3B:
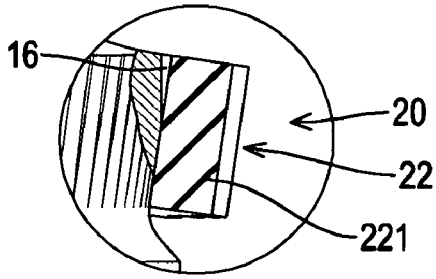
FIG. 3B is an enlarged side view in partial section of the tool element in FIG. 3A.
Figure 5A:
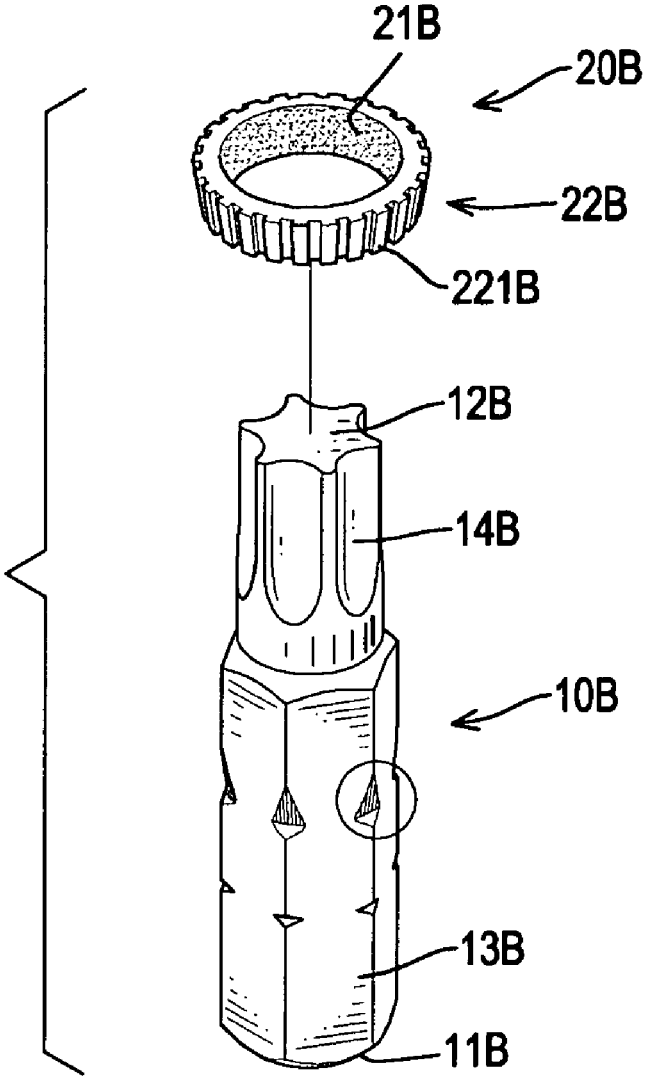
FIG. 5 A is an exploded perspective view of a third embodiment of a tool element in accordance with the present invention.
FIG. 5B is an enlarged perspective view of the tool element in FIG. 5A.
Figure 5B:
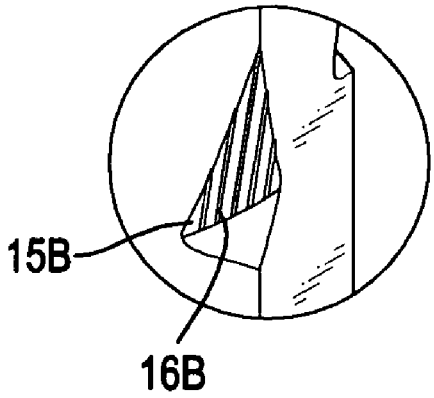

The operating end (12, 12A, 12B) of the body (10, 10A, 10B) is formed with the connecting end (11, 11A, 11B) of the body (10, 10A, 10B) and is used to loosen or fasten a nut or a bolt. With reference to FIGS. 3 and 4, the operating end (12, 12A) of the body (10, 10A) may have a hexagonal hole (14, 14A). With reference to FIG. 5A, the operating end (12B) of the body (10B) may be a hex key (14B).

The mounting recess (15, 15A, 15B) is annularly formed round the external surface of the body (10, 10A, 10B) between the ends (11, 11A, 11B, 12, 12A, 12B) and has a bottom face. Preferably, with reference to FIG. 3, the mounting recess (15) is formed on the external surface of the body (10) as a conical shape from the connecting end (11) to the operating end (12) of the body (10). Alternatively, with reference to FIG. 5B, the mounting recess (15B) is formed on the hex key (14B) of the body (10B).

Figure 2:
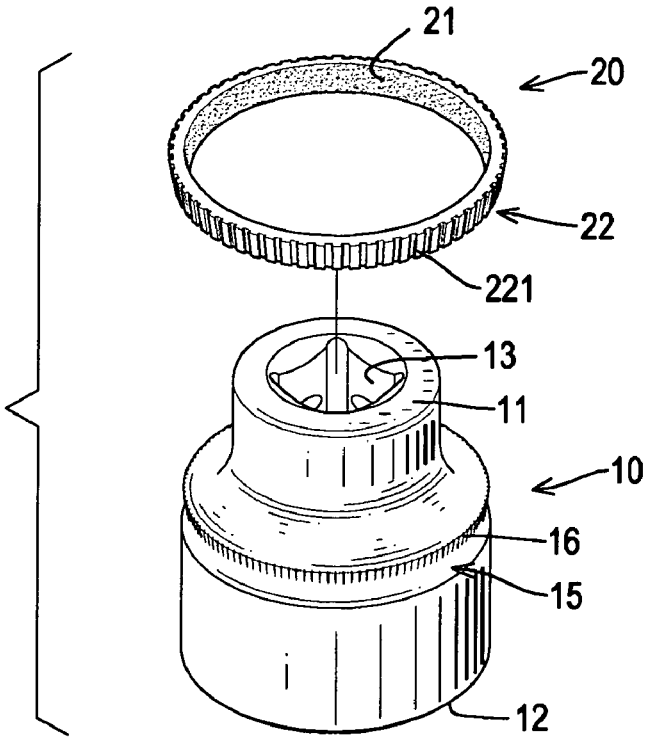
FIG. 2 is an exploded perspective view of the tool element in FIG. 1.

The notches (16, 16A, 16B) are formed on the bottom face of the mounting recess (15, 15A, 15B) at intervals. With reference to FIG. 2, each notch (16) has a length shorter than a height of the bottom face of the mounting recess (15). Preferably, with reference to FIGS. 4 and 5B, the notches (16A, 16B) have the same lengths as the height of the bottom face of the mounting recess (15A, 15B).

The anti-skid collar (20, 20A, 20B) is annular, is detachably mounted around the body (10, 10A, 10B) and has an inner surface, an outer surface, a holding face (21, 21A, 21B) and an anti-skid face (22, 22A, 22B). The holding face (21, 21A, 21B) is formed on the inner surface and is rubbed against the notches (16, 16A, 16B) of the body (10, 10A, 10B) to hold the anti-skid collar (20, 20A, 20B) securely on the body (10, 10A, 10B). The anti-skid face (22, 22A, 22B) is formed on the outer surface of the anti-skid collar (20, 20A, 20B) and has multiple teeth (221, 221A, 221B). The teeth (221, 221A, 221B) are formed on and protrude from the anti-skid face (22, 22A, 22B) at intervals to provide skid-proof effect when the tool element is rotated.

The anti-skid collar (20, 20A, 20B) can be held on the body (10, 10A, 10B) by the holding face (21, 21A, 21B) rubbing with the notches (16, 16A, 16B) of the body (10, 10A, 10B). When using the tool element in accordance with the present invention to loosen a nut or a bolt, the teeth (221, 221A, 221B) on the anti-skid face (22, 22A, 22B) of the anti-skid collar (20, 20A, 20B) provide an anti-skid effect to allow a user to tightly hold the tool element even if the user wears gloves or is stained with lubricating fluid or oil on hands. In addition, the anti-skid collar (20, 20A, 20B) mounted around the body (10, 10A, 10B) can also prevent the socket or the bit from rolling arbitrarily and this is conveniently in use and storage.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool element comprising a body having an external surface;

a connecting end;

an operating end formed with the connecting end of the body;

a mounting recess annularly formed round the external surface of the body as a conical shape from the connecting end to the operating end of the body and having a bottom face with a height; and multiple notches formed in the bottom face of the mounting recess at intervals, and each notch having a length shorter than the height of the bottom face of the mounting recess of the body; and an anti-skid collar being annular, detachably mounted around the body and having an inner surface;

an outer surface;

a holding face formed on the inner surface and rubbed against the notches of the body to hold the anti-skid collar securely on the body; and an anti-skid face formed on the outer surface of the anti-skid collar.

2. The tool element as claimed in claim 1, wherein the anti-skid face has multiple teeth formed on and protruding from the anti-skid face of the anti-skid collar.

3. The tool element as claimed in claim 2, wherein the body is a socket;

the connecting end has a quadrate mounting hole; and the operating end has a hexagonal hole.

4. The tool element as claimed in claim 2, wherein the body is a bit;

the connecting end is a hexagonal shaft; and the operating end is a hex key.

5. The tool element as claimed in claim 4, wherein the mounting recess is formed on the hex key of the body.

* * * * *